United States Patent [19]

Dysarz

[11] Patent Number: 4,768,899

[45] Date of Patent: Sep. 6, 1988

[54] DEVICE AND METHOD TO CUT PILES

[76] Inventor: Edward D. Dysarz, 11423 Triola La., Houston, Tex. 77072

[21] Appl. No.: 40,085

[22] Filed: Apr. 20, 1987

[51] Int. Cl.[4] ..... E02D 9/04

[52] U.S. Cl. ..... 405/195; 30/92; 30/103; 83/191; 166/55; 166/55.7; 405/226; 405/227

[58] Field of Search ..... 405/227, 226, 232, 195, 405/248, 231; 166/55, 55.1, 55.2, 55.6, 55.7, 55.8; 30/92, 103, 106; 83/191, 178, 180, 184

[56] References Cited

U.S. PATENT DOCUMENTS

| | | | |
|---|---|---|---|
| 1,756,128 | 4/1930 | Monroe | 166/55.7 |
| 1,801,424 | 4/1931 | Gray | 166/55.8 |
| 2,084,606 | 6/1937 | Brannon et al. | 166/55.7 |
| 2,526,695 | 10/1950 | Schlumberger | 166/55.2 X |
| 2,638,165 | 5/1953 | Barber | 166/55.2 |
| 2,728,138 | 12/1955 | Guild | 30/92 |
| 2,884,066 | 4/1959 | Teplitz et al. | 166/55 |
| 2,915,819 | 12/1959 | O'Day et al. | 30/108 |
| 3,000,248 | 9/1961 | Boughton | 83/191 |
| 3,690,380 | 9/1972 | Grable | 166/55.1 X |
| 4,619,556 | 10/1986 | Parra | 405/227 X |

*Primary Examiner*—Dennis L. Taylor

[57] ABSTRACT

A device and method for severing the piles, grout and structural sleeves of vertical marine structures, from the inside of the structural member or the outside of the structural member. The device will sever the pile, grout or sleeve without jamming even though the weight of the marine structure is bearing down on the pile, grout or sleeve. The device is first lowered into the pile at the desired elevation and further locked onto the wall of the pile. Once the device is locked onto the pile, the cutter is lowered and proceeds to cut into the pile, grout and sleeve. When a sufficient section of the pile, grout or sleeve has been cut, spacers with barbs are forced into the slot formed by the cutter blade and are held in place by the barbs. After the spacers are in place, the remainder of the pile is severed with the cutter blade and a continuity check is made of the pile. An electric probe is placed on the lower section of the pile and if the pile is completely severed, a readout should indicate an open electric circuit. If any portion of the pile is still uncut, the readout should indicate a closed electric circuit. When a closed circuit is indicated, the cutter will rotate and cut the pile where it is uncut.

8 Claims, 12 Drawing Sheets

DEVICE AND METHOD TO CUT PILES

BAGRGROUND OF THE INVENTION

1. Field of the Invention

The present invention relates to the cutting of piles or tubes below the surface of the water or below the surface of the ground or the sea floor. The present invention has been found to be particularly useful in severing piles that support marine structures on the sea floor while the piles are supporting a vertical load and hence will be discussed with particular reference thereto. However, the present invention is applicable to other types of operations such as severing piles and bridges and or buildings that are being removed or demolished.

2. Description of the Prior Art

In the offshore industry, there are many marine structures or production platforms that are held in place on the sea floor by tubular piles of various diameters. The piles are often driven into the sea floor several hundred feet. The production platforms are used to support drilling and or production components required for the extraction of petroleum and gas. When all of the petroleum or gas is extracted, the production platform must be removed. One of the first requirements for removing a production platform is to cut or sever the piles below the sea floor or mudline.

In the past, explosives or charges were lowered into the pile and the pile was blasted apart. Blasting is usually effective, however, there are several problems associated with the use of explosives. The first problem is that sometimes the explosive does not completely sever the pile and a section of the pile is still connected to the production platform. If there is, say a square inch of steel that remains unsevered with, say a tensile strength of 80,000 pounds, it would be difficult or impossible to remove the structure. If the unsevered area is even greater the removal problem is far greater. When this happens, a diver must go down and burn the unsevered area off. In deep water this can become another major problem.

The second problem with blasting piles is that the shock associated with blasting kills a lot of marine creatures, such as sea turtles that are on the endangered species list. At the time of this writing, all blasting of piles or sleeves of production platforms has been suspended as a result of the killing of marine life.

Another method of severing piles is to cut the piles with a cutting torch. To cut a pile from the inside, a diver must be lowered inside of the pile, often in an upside down position where he will burn the pile with a cutting torch. If the pile is inside of a sleeve with grout (cement) between the pile and the sleeve, the cutting torch will not be able to cut into the sleeve because the cutting flame will spread out. The sleeve must be cut from the outside and the pile must be cut from the inside. This double cut with divers is very expensive, dangerous and difficult.

A third method for cutting piles is to use a rotating cutter. Rotating cutters are often used to cut casings and drill pipe and are very effective. The problem that is encountered in cutting piles is that the pile is in compression and not in tension as are casing and drill pipe when they are cut. When a rotating cutter cuts through part of the pile, the weight of the production platform and the pile will collapse on the cutter and cause the cutter to jam before the pile is entirely severed. This also prevents the cutter from cutting through a pile, grout and a sleeve at the same time.

A fourth method is the use of a single hydraulic ram to sheer the pile from the outside. Since this must be done only from the outside and below the mudline, a hole must be dug around the pile which is expensive and time consuming. This type of pile cutter can also only cut small diameter piles (about 36") and if it were used on a large diameter pile, the size of the cutter would be too great to handle and the size of the hole may not be possible to dig in deep water. This type of cutter can not shear through the pile, grout and sleeve at one time.

OBJECTS OF THE INVENTION

In the preferred embodiment, the pile cutting device may be further equipped with a pair of stabilizers to hold the pile cutter in place while the pile is being cut, a pair of spacers are inserted into the cut to prevent the pile from collapsing on the cutter and at least one probe that will allow the cutter operator to determine if the pile is completely severed.

Accordingly, it is the object of this invention to provide an improved apparatus for efficiently cutting piles below the mudline on an offshore production platform.

Another object of the present invention is to efficiently cut piles, grout and sleeves of offshore production platforms without harming the marine environment.

A further object of the present invention is to safely cut piles, grout and sleeves of offshore production platforms without the aid of divers.

A still further object of the present invention is to hold the piles, grout and sleeves in place while the piles, grout and sleeves are being cut and after the piles, grout and sleeves have been cut.

Another object of the invention is to allow the pile cutter operator or others to determine if the pile is completely severed to allow for the efficient removal of the offshore production platform.

BRIEF DESCRIPTION OF THE DRAWINGS

For a further understanding of the nature and objects of the present invention, reference should be had to the following detailed description of the preferred embodiments thereof taken in conjunction wit the accompanying drawings, in which like parts are given like numerals and wherein.

DETAILED DESCRIPTION OF THE PREFERRED EMBODIMENT

The preferred embodiment of the present invention may be used to sever tubular piles that are supporting an offshore production platform that must be removed; the piles may be cut above or below the mudline on the sea floor.

The ability to sever a pile without causing the cutter blade to be jammed in the wall of the pile caused by the pile collapsing from the weight of the offshore production bearing on the pile as the pile is being severed, is accomplished by placing spacers into the partial cuts in the pile wall. The spacers will prevent the pile from collapsing vertically onto the cutter and will also prevent the pile from shifting horizontally after the pile is completely severed.

Another important part of the pile cutting device is the ability to determine if the pile is completely severed or if a segment of steel is still intact; this coupled with the ability to re-enter the cut of the pile and sever any remaining segments will prevent a lot of costly delays in the removal of an offshore production platform.

Although the preferred embodiment of the invention places more emphasis on the cutting through piles only, the pile cutter could also cut through a combination of pile, grout and sleeve in only one cut.

DEVICE AND ITS METHOD OF USE

Figure 1:
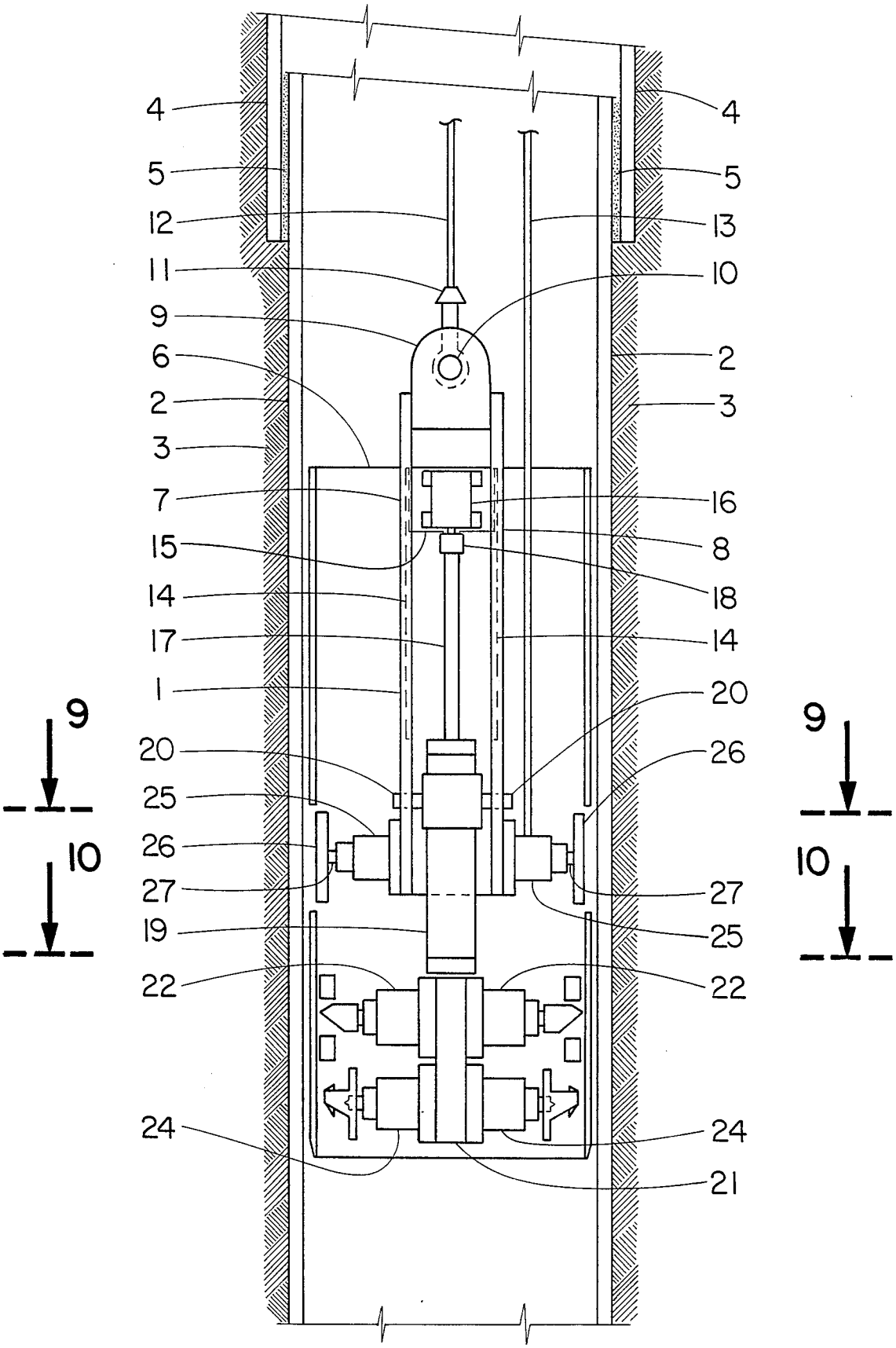
FIG. 1 s an elevation view of embodiment 1 of the apparatus of the present invention shown while being lowered into a pile.

Referring to FIG. 1, there is shown the pile cutting device 1 inside of a pile 2. The pile 2 is shown in the ground 3. At the upper part of the pile 2, there is shown the lower part of sleeve 4 of the production platform not shown. The pile 2 is shown connected to the sleeve 4 by grout 5. Grout 5 is also referred to as cement.

The pile cutting device 1 is protected by a guide tube 6 that has a lesser outside diameter than the inside diameter of the pile 2. The guide tube 6 also serves to protect machinery, etc. of the pile cutting device 1 from damage as it is being lowered into the pile 2 or as it is being removed from the pile 2.

The pile cutting device 1 is connected to the guide tube 6 by frame member 7 and frame member 8. At the top of the frame members 7 and 8 is a lifting plate 9. The lifting plate 9 has a hole 10 wherein a lifting socket 11 is placed. The lifting socket 11 is suitably attached to a cable 12 that is used to raise and lower the pile cutting device 1 within the pile 2. The cable 12 is further attached to a winch not shown that is located at the upper end of the pile 2.

Running parallel to the cable 12 is the power and control line 13. The power and control lines 13 consist of hydraulic lines and electric cables held together in one bundle and are held at the top of the pile by a cable reel not shown.

On each of the frame members 7 and 8, there is a slot 14 that holds a guide plate 15 and allows the guide plate 15 to move up and down. The guide plate 15 supports a rotary actuator 16. The rotary actuator 16 is connected to a cylinder rod 17 by a coupling 18. The rotary actuator 16 rotates the cylinder rod 17 more than 360 degrees.

The cylinder rod 17 runs through the double acting hydraulic cylinder 19. The double end rod hydraulic cylinder 19 is mounted to the frame members 7 and 8 by trunnions 20. Suitably connected to the lower end of the cylinder rod 17 that runs through the double end rod hydraulic cylinder 19 is the cutter foundation 21. The cutter foundation 21 supports the cutter hydraulic cylinders 22, and the spacer cylinders 24. All of the cylinders are fastened to the cutter foundation 21 by bolts or other suitable means.

Suitably bolted to the lower end of the frame members 7 and 8 are the stabilizer cylinders 25. The stabilizer cylinders 25 have stabilizer pads 26 that are suitably fastened to the rods 27 of the stabilizer cylinders 25. The stabilizer pads 26 are shown in an open position.

Figure 2:
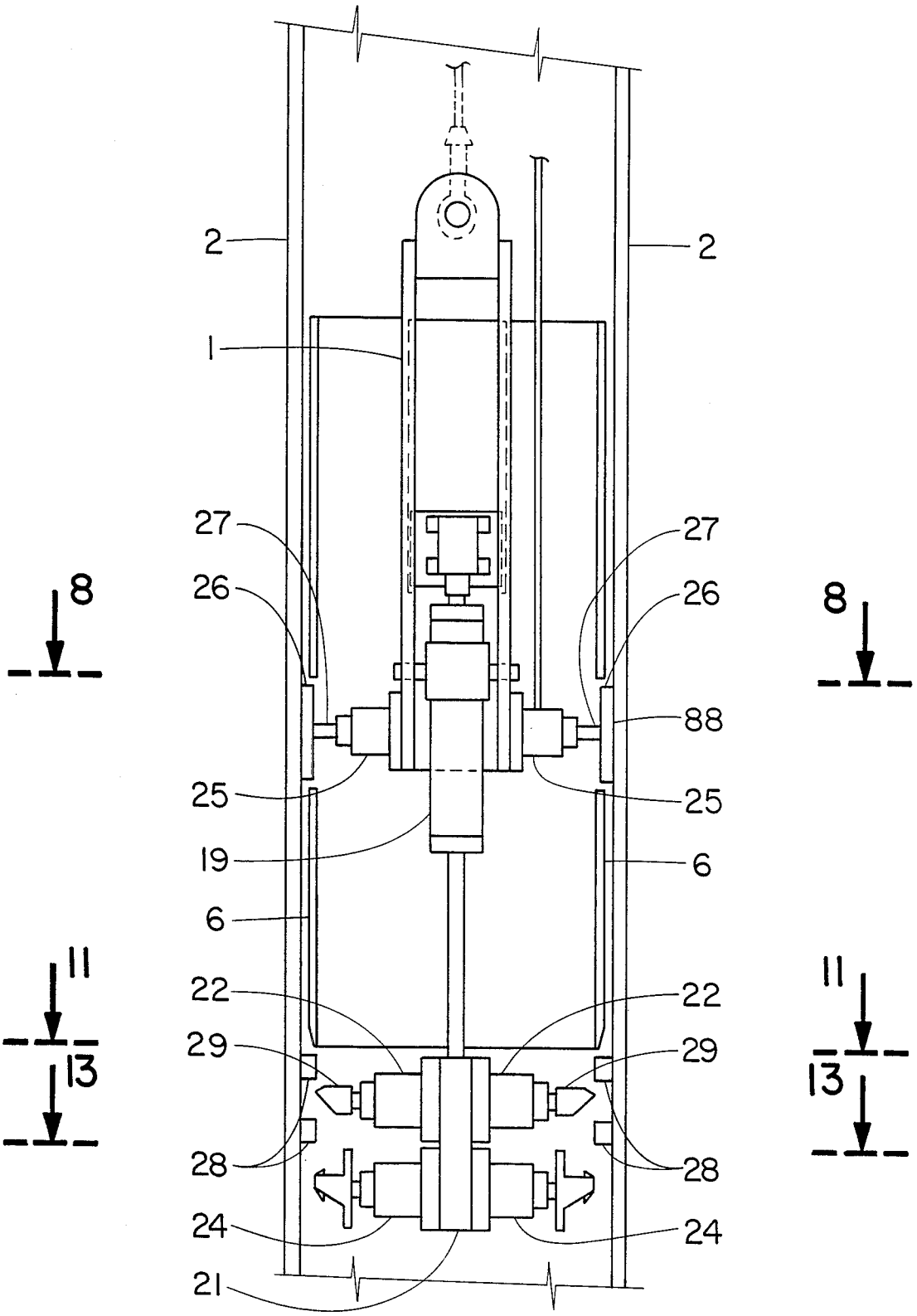
FIG. 2 is an elevation view of the present invention after it has been lowered into the cutting position inside of a pile and locked off.

Referring to FIG. 2, there is shown the start of the operation of the pile cutting device 1.

The first movement is the stabilizer cylinders 25 push the rods 27 and stabilizer pads 26 into the inside wall 88 of the pile 2. The stabilizer pads 26 hold the pile cutting device 1 in place during the entire pile cutting operation.

Once the stabilizer pads 26 are in place, the double end rod cylinder 19 lowers the cutter foundation 21, the cutter hydraulic cylinders 22 and the spacer cylinders 24 below the lower end of the guide tube 6.

When the above mentioned devices are lowered, the cutter stabilizer guides 28 are pushed into the pile 2 wall and held in place. (The cutter stabilizer guide 28 will be further explained and shown in FIGS. 10 and 11.) This will enable the cutter blades 29 to penetrate the pile 2 without causing the cutter foundation 21 to move.

Figure 3:
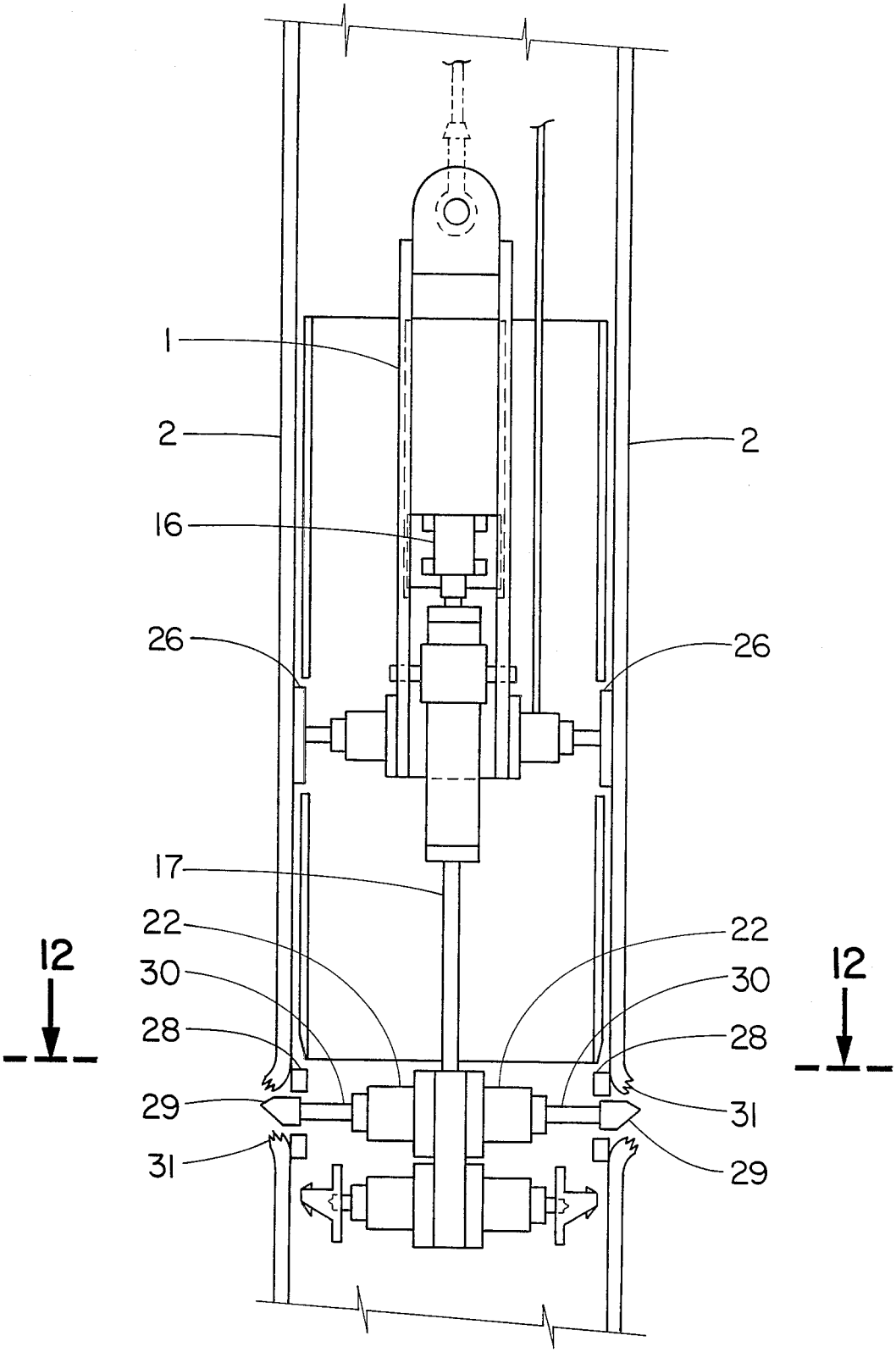
FIG. 3 is an elevation view of the present invention showing the cutter blade penetrating a pile.

Referring to FIG. 3, there is shown the pile cutting device 1 firmly held in place inside of the pile 2 by the stabilizer pads 26 and the cutter stabilizer guides 28. The cutter blade 29 has been thrust through the pile 2 by the cutter blade rod 30 and the cutter hydraulic cylinder 22.

Although only the initial cut 31 into the pile is shown in FIG. 3, the next step is that the cutter blade 29 is withdrawn from the pile 2, the cutter stabilizer guide 28 is withdrawn from the pile 2 and the rotary actuator 16 rotates the cylinder rod 17 about 2 degrees which further rotates the cutter hydraulic cylinders 22 and the cutter stabilizer guide 28 the same two degrees. When the cutter stabilizer guide 28 has been rotated the two degrees, it is again pushed into the pile 2. Once the cutter stabilizer guide 28 has been pushed into the pile 2, the cutter blade is again pushed into the pile 2 and thus increases the length of the cut 31. These steps are repeated until the cut 31 is of sufficient length to proceed with the next step as shown in FIG. 4.

Figure 4:
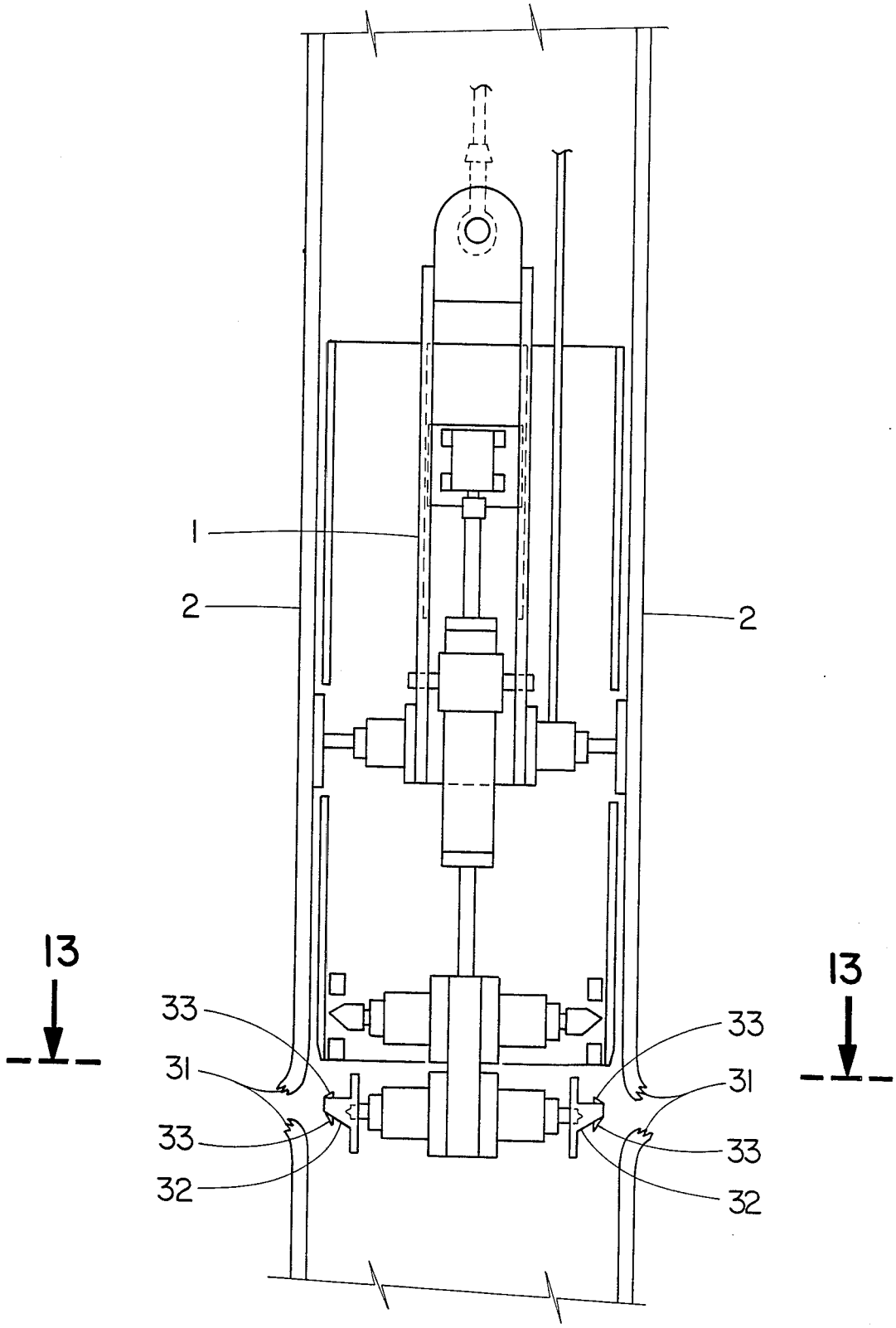
FIG. 4 is an elevation view of the present invention showing the cutter blade moved away from the cut and the spacer moved near the cut.

Referring to FIG. 4, there is shown the pile cutting device 1 inside of a pile 2. The cut 31 has been made sufficiently long to be capable of receiving a spacer 32.

A spacer 32 is a device that is made of a material with a high resistance to compression. The material could be steel, but in most cases should be made up of a resin or other suitable materials that will not conduct electricity. The spacer 32 is fitted with barbs 33 that can be compressed as the spacer 32 is pushed into the cut 31 but will expand and will not allow the spacer 32 to be pulled out of the cut 31.

Still referring to FIG. 4, there is shown the spacers 32 elevated to line up with the cut 31.

Figure 5:
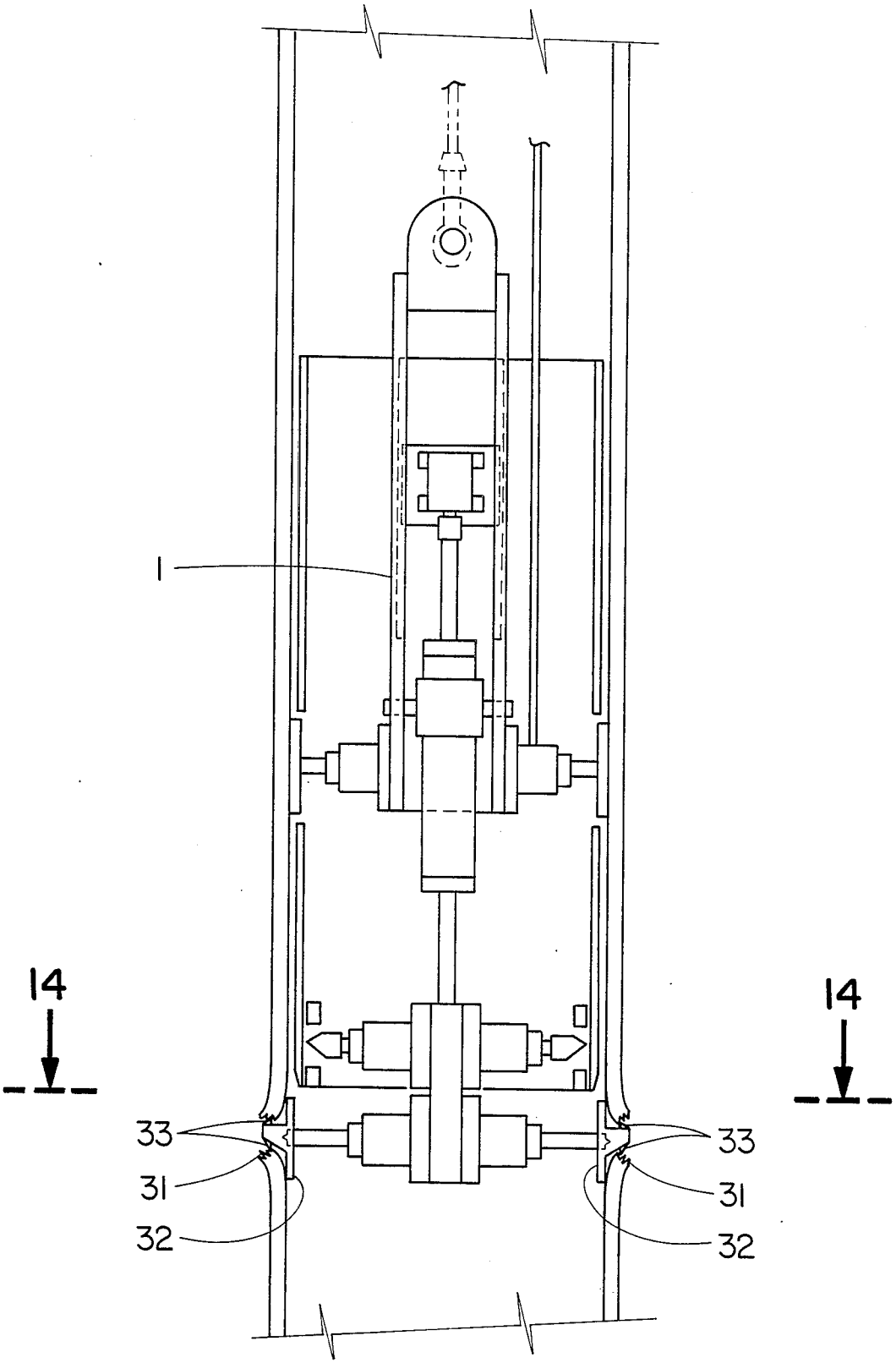
FIG. 5 is an elevation view of the present invention showing the spacer inserted into the cut in a pile.

Referring to FIG. 5, there is shown the pile cutting device 1 in which the spacers 32 have been inserted into the cuts 31. The barbs 33 on the spacers 32 have contracted as the spacers 32 were inserted into the cuts 31 and then automatically re-opened after the barbs 33 were moved through the cut 31 area.

Figure 6:
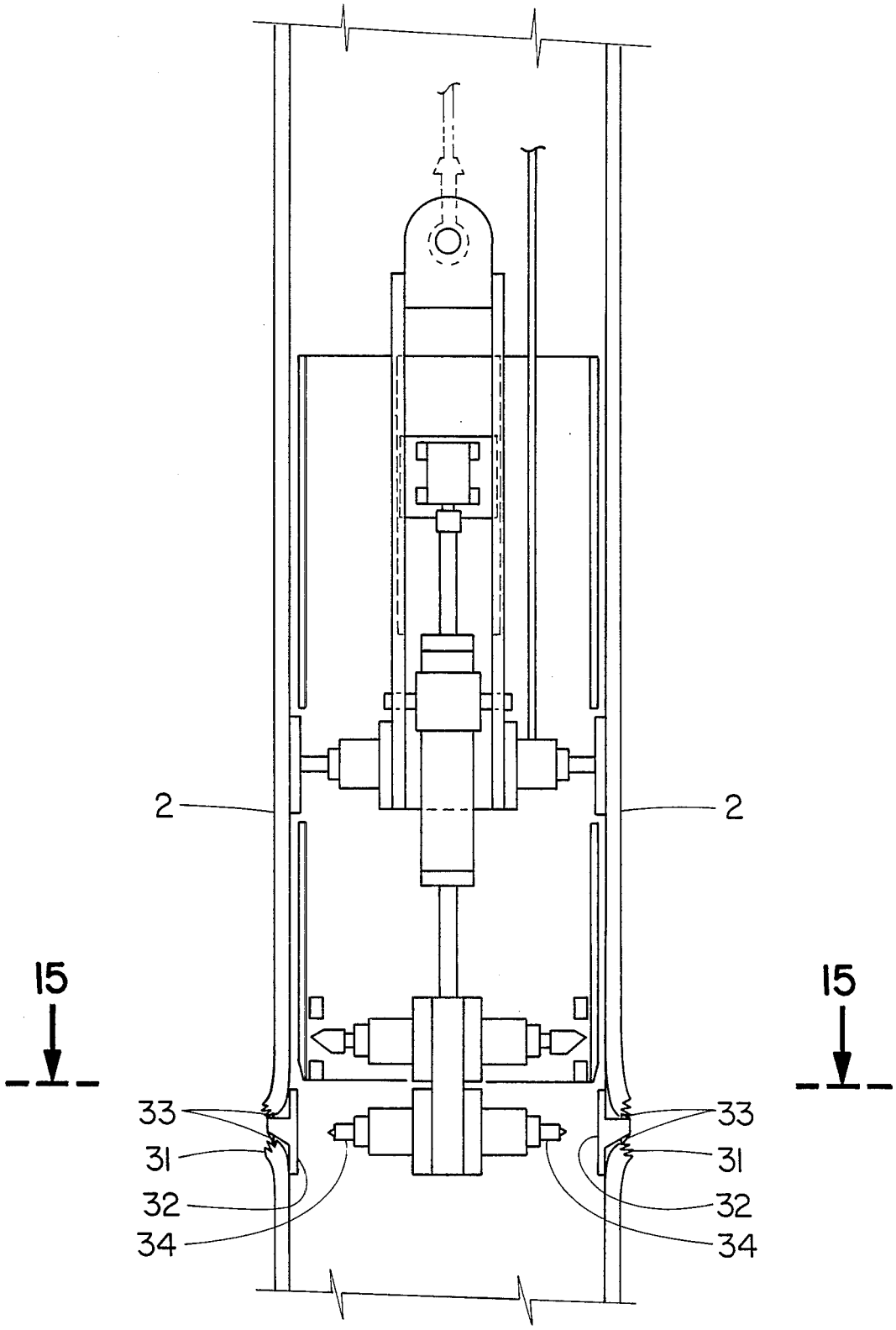
FIG. 6 is an elevation view of the present invention showing the hydraulic cylinder rods withdrawn from the spacers with the probe exposed.

Referring to FIG. 6, there is shown the spacer 32 inserted in the cut 31 with the barbs 33 caught on the outer edges of the cuts 31. The spacer cylinder rods 34 have been pulled out of the spacers 32. The spacers were held to the spacer cylinder rods by friction or by a shear pin, not shown, and when the spacer cylinder rods 34 were pulled back, they pulled out of the spacers 32, thus leaving the spacers 32 in the cuts 31.

The spacers 32 are left in the cuts 31 after the cuts 31 have been made longer than the spacers, but before the cuts 31 have been made completely around the circumference of the pile 2. Once the spacers 32 have been inserted into the pile 2, the remainder of the pile 2 will be cut until the pile 2 is completely severed.

Figure 7:
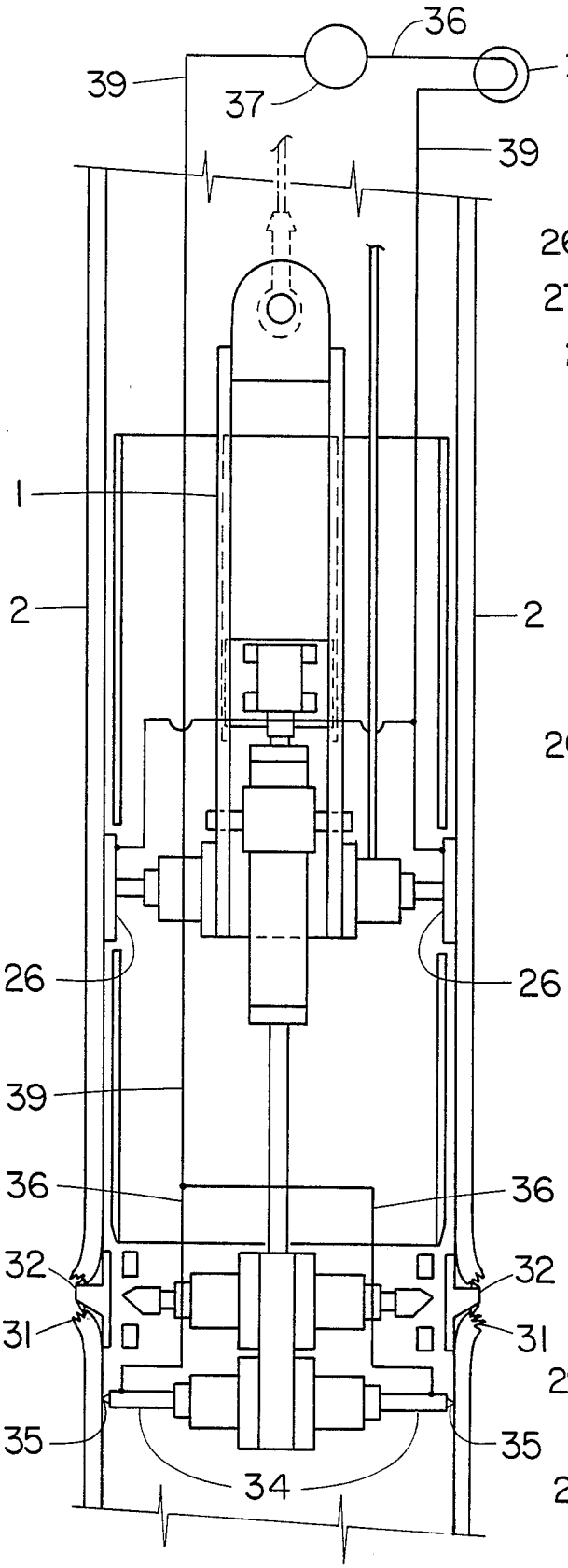
FIG. 7 is an elevation view of the present invention showing the discontinuity check being made with the probe and the electrical circuit.

Referring to FIG. 7, there is shown a means of electrically testing the pile 2 cut 31 to determine if the pile 2 is completely severed. The electrical schematic diagram of a circuit 39 is shown superimposed over the pile cutting device 1.

Once the pile 2 is thought to be completely severed and the non-metallic spacers 32 are in place, a probe 35 at the end of the spacer cylinder rod 34 is thrust into the lower section of pile 2. Connected to each spacer cylinder rod 34 is an electric conductor 36 that is connected to a battery 37 or other suitable power source, that is located on the outside of the pile 2. From the battery 37, the electric conductor 36 is connected to a lamp 38. From the lamp 38, the electric conductor is run back down into the pile 2 where it is connected to the stabilizer pads 26 which are connected to the upper section of the pile 2.

When the probe 35 is thrust into the pile 2 and the pile 2 is completely severed, the electric current will not flow through the circuit 39 because the cut 31 in the pile 2 will cause an open circuit 39. If the pile is not completely severed, the lamp 38 will light up because the electric circuit 39 will be complete.

The ability to test the pile 2 to determine if the pile 2 is completely severed could save a lot of time and money on removing the offshore production platform.

Figure 8:
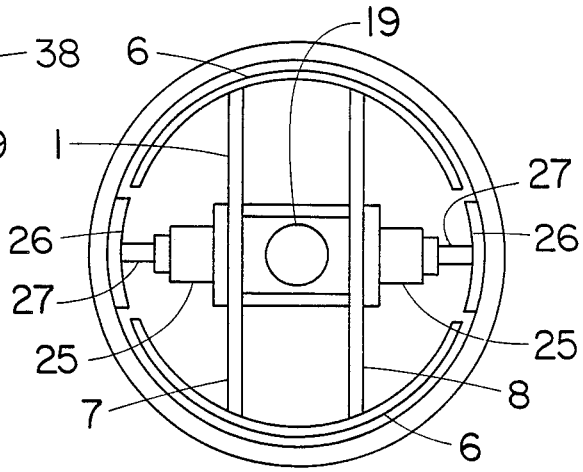
FIG. 8 is a section taken through FIG. 2 of the stabilizers holding on to a pile.

Referring to FIG. 8, there is shown a section plan view of the pile cutting device 1 taken through FIG. 2 with the stabilizer pads 26 locked onto the pile 2.

Also shown are the frame members 7 and 8 that support the stabilizer cylinders 25. The rods 27 are pushed out of the stabilizer cylinders 25 thus pushing on the stabilizer pads 26 which push into the pile 2 wall.

The frame members 7 and 8 are also shown suitably fastened to the guide tube 6. The double end rod hydraulic cylinder 19 is shown between the frame members 7 and 8.

Figure 9:
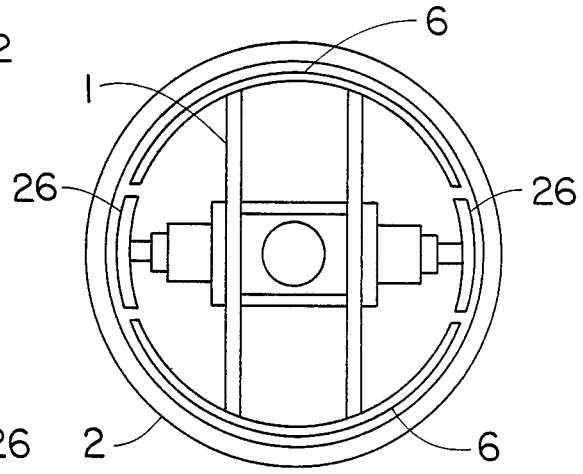
FIG. 9 is a section taken through FIG. 1 of the stabilizer in an open position.

Referring to FIG. 9, there is shown a section plan view of the pile cutting device 1 taken through FIG. 1. The stabilizer pads 26 are shown in a open position thus allowing the guide tube 6 to be moved up or down inside of the pile 2.

Figure 10:
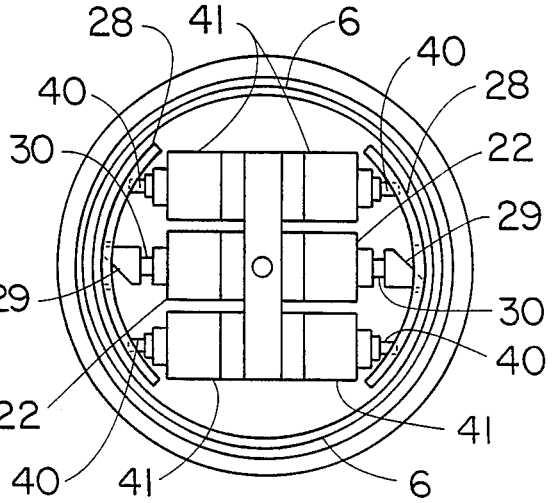
FIG. 10 is a section taken through FIG. 1 showing the cutter, the cutter guide and the cutter blade.

Referring to FIG. 10, there is shown a section plan taken through FIG. 1 of the cutter hydraulic cylinders 22 with the cutter blades 29 attached to the cutter blade rod 30.

The cutter stabilizer guides 28 are held in place by the stabilizer guide rods 40 and the stabilizer guide cylinders 41. The cutter stabilizer guides 28 are shown in a retracted position inside of the guide tube 6.

Figure 11:
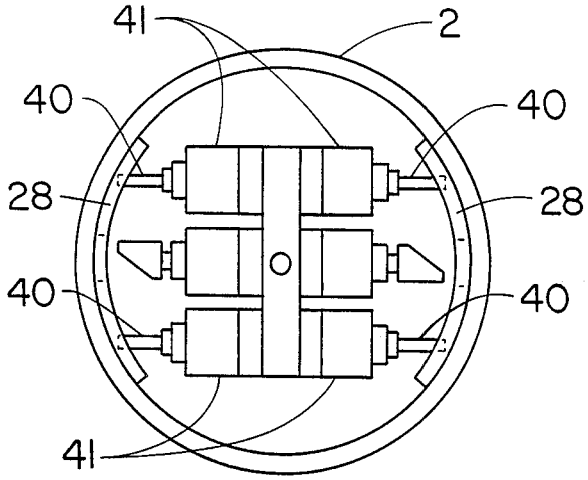
FIG. 11 is a section taken through FIG. 2 showing the cutter guide pushed into the pile.

Referring to FIG. 11, there is shown a section plan view taken through FIG. 2 of the cutter stabilizer guides 28.

The cutter stabilizer guides 28 are shown pushed into the pile 2 by the stabilizer guide rods 40 and the stabilizer guide cylinders 41. The cutter stabilizer guide 28 is forced into the pile 2 and is held in place and prevented from moving laterally by radial gripping segments 42 (not seen in this view) that are detailed in FIG. 21. The radial gripping segments 42 are part of the cutter stabilizer guide 28 and are pushed into the pile 2 wall and will not allow the cutter stabilizer guide 28 to move in any direction.

Figure 16:
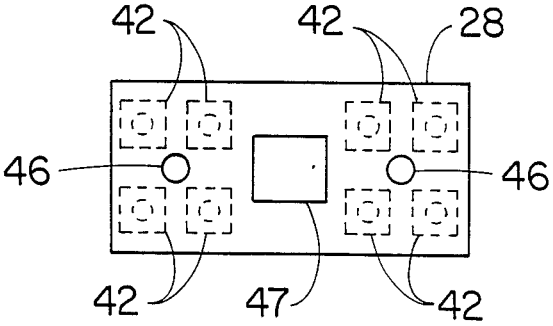
FIG. 16 is a detail of the cutter guide.

The pile stabilizer guide 28 is further detailed in FIG. 16.

Figure 12:
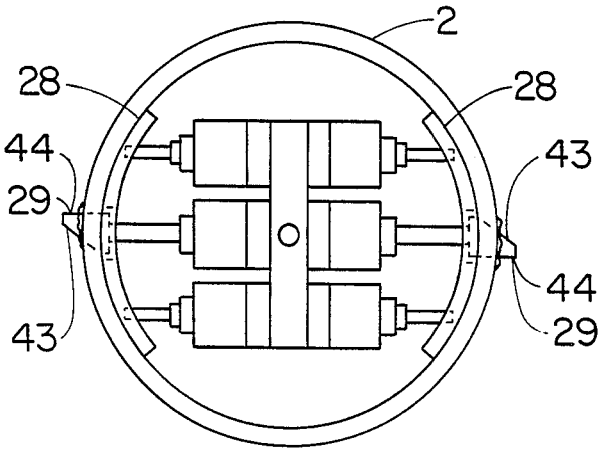
FIG. 12 is a section taken through FIG. 3 showing the cutter blades after they have been pushed through the pile wall.

Referring to FIG. 12, there is shown a section plan view taken through FIG. 3.

The pile stabilizer guides 28 are held in place against the pile 2 wall as the cutter blades 29 are pushed through the pile 2. The cutter blades 29 are sloped 43 so that as it is pushed into the pile 2 it only cuts a small segment of the pile 2, therefore, concentrating more force on a small area of the pile 2. To prevent the cutter blade 29 from moving laterally as it cuts into the pile 2, the straight part 44 of the cutter blade 29 is forced against the cutter stabilizer guide 28.

The cutter stabilizer guide 28 also prevents the pile 2 from distorting by placing hoop stress on the pile 2 as the cutter blade 29 is being pushed into and through the pile 2.

Figure 13:
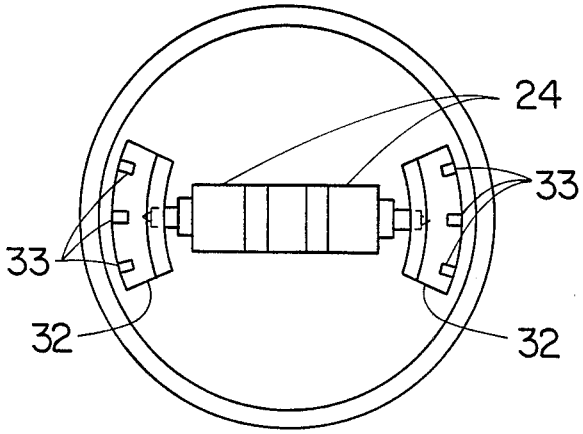
FIG. 13 is a section taken through FIG. 2 showing the spacers.

Referring to FIG. 13, there is shown a section plan view taken through FIG. 2 of the spacer cylinders 24 and the spacers 32 with barbs 33.

The spacers 32 are shown with three barbs 33. The barbs 33 are shown in greater detail in FIG. 26.

Figure 14:
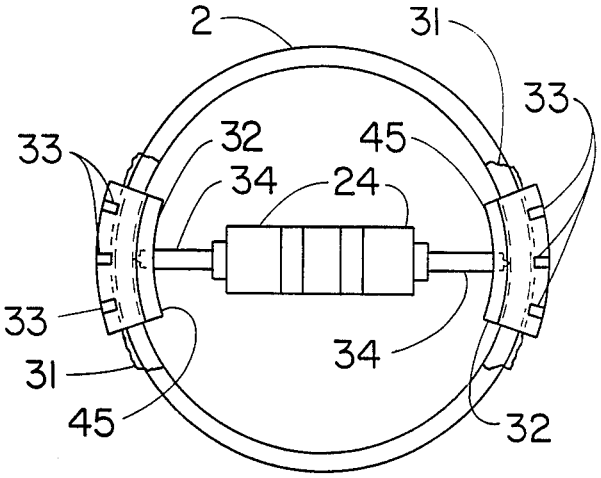
FIG. 14 is a section taken through FIG. 5 showing the spacers bein pushed into the cut in the pile wall.

Referring to FIG. 14, there is shown a section plan view taken through FIG. 5.

The cuts 31 have been made in the pile 2 and are of a sufficient length to allow the spacer 32 to be inserted. The spacer 32 is pushed into the cut 31 until the stop flange 45 is pushing against the pile 2 wall and the barbs 33 are caught in parts of the cut 31. The spacers 32 are pushed into the cuts 31 by the spacer cylinders 24 reacting on the spacer cylinder rods 34 which push the spacers 32 into the cuts 31.

Figure 15:
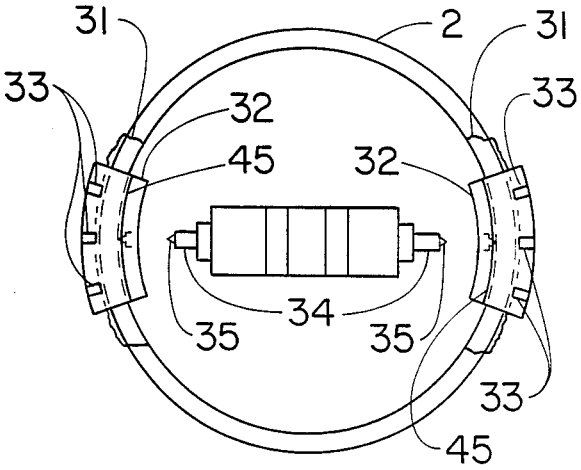
FIG. 15 is a section taken through FIG. 6 showing the spacers in the cut with the cylinder rods withdrawn.

Referring to FIG. 15, there is shown a section plan view taken through FIG. 6.

The spacers 32 are shown being held in the pile cuts 31 by the barbs 33 on one side and the stop flange 45 on the other side. When the pile 2 is completely severed, the pile 2 will be unable to drop because the spacers 32 will support the weight of the pile and the pile 2 will not be able to move laterally because the barbs 33 and the stop flanges 45 will prevent lateral movement.

Although only two spacers 32 are shown, there could be more used, which would only require more spacer cylinders 24, etc. The more spacers 32 used, the greater the structural stabilility of pile 2, after the pile 2 is severed.

FIG. 15 also shows the spacer cylinder rods 34 withdrawn from the spacers 32. At the end of the spacer cylinder rods 34 are the probes 35.

Referring to FIG. 16, there is shown a detail of the cutter stabilizer guide 28.

On one side of the cutter stabilizer guide 28 are two holes 46 for the stabilizer guide rods 40 to fit. Shown in hidden lines representing the other side of the cutter stabilizer guide 28 are the radial gripping segments 42 which are detailed in FIG. 22.

In the center of the cutter stabilizer guide 28 is the guide cut out 47 that guides the cutter blade as it is pushed into the pile 2.

Figure 17:
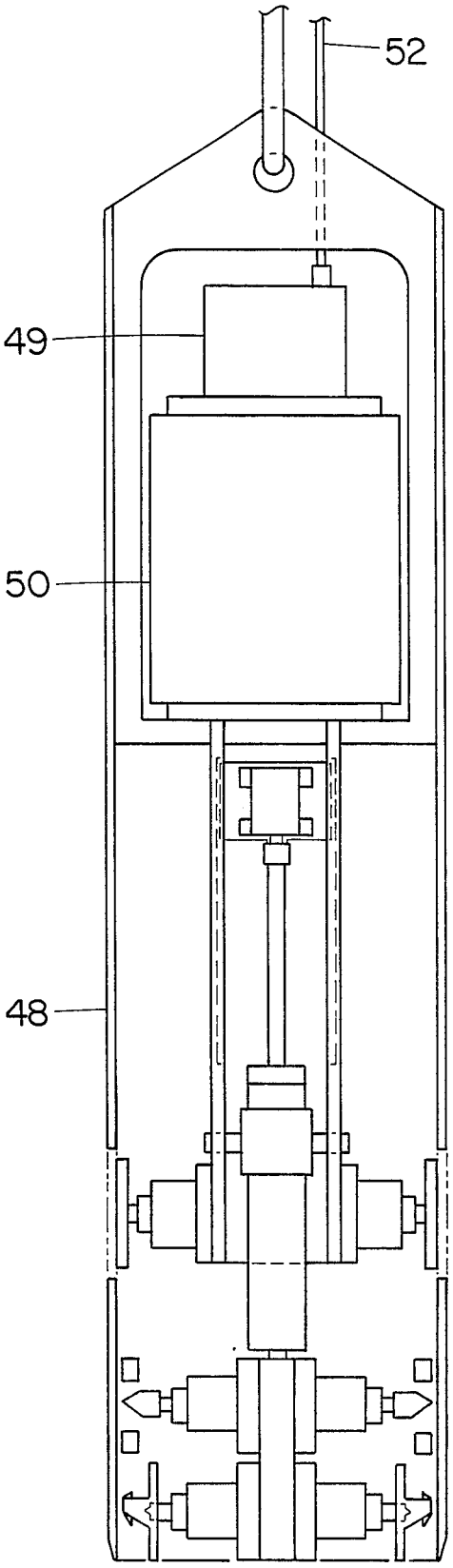
FIG. 17 is an elevation view of another embodiment of the present invention.

Referring to FIG. 17, there is shown a second embodiment of a pile cutting device 48.

Most of the pile cutting device of FIG. 17 is the same as shown in FIG. 1. The only difference is the pile cutting device 48 of FIG. 17 has an electric motor 49 and a hydraulic pump 50 that is part of the whole unit. The only cable required is an electric power cable and control line 52 in one bundle.

Figure 18:
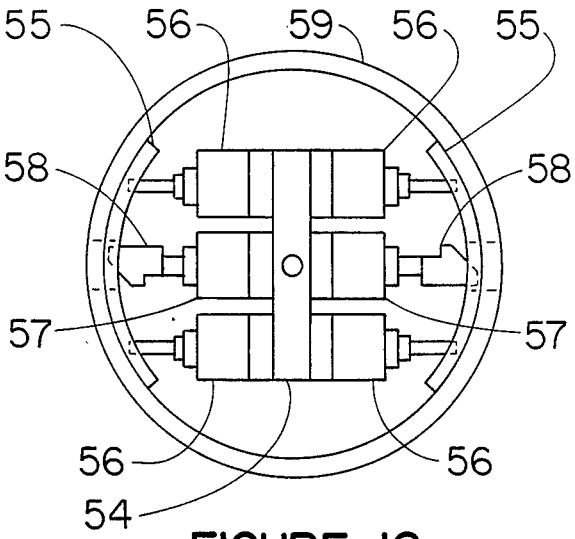
FIG. 18 is a plan view of another type of cutter blade.

Referring to FIG. 18, there is shown a plan view of another embodiment of the invention.

Shown in FIG. 18 is the cutter foundation 54, cutter stabilizer guides 55, stabilizer guide cylinders 56 and the cutter hydraulic cylinders 57. The cutter blades 58 are different.

The cutter blade 58 is in the configuration of a hook and it is designed to cut on a stroke going toward the center of the pile 59.

Figure 19:
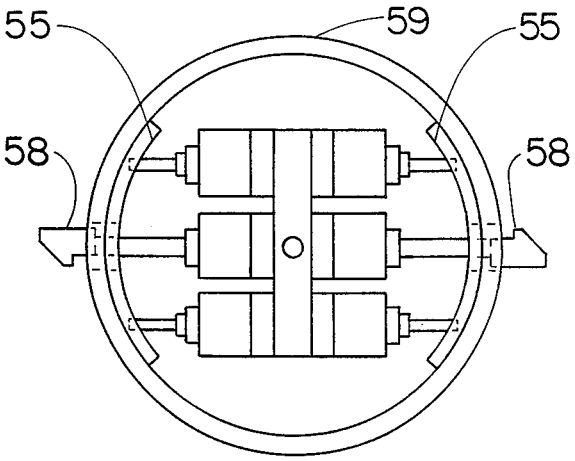
FIG. 19 is a plan view of the cutter blade penetrating a pile.

Referring to FIG. 19, the cutter blades 58 are shown thrust through the pile 59.

The cutter stabilizer guides 55 are pushed into the pile 59 wall and guides the cutter blades 58 as they penetrate the pile.

Figure 20:
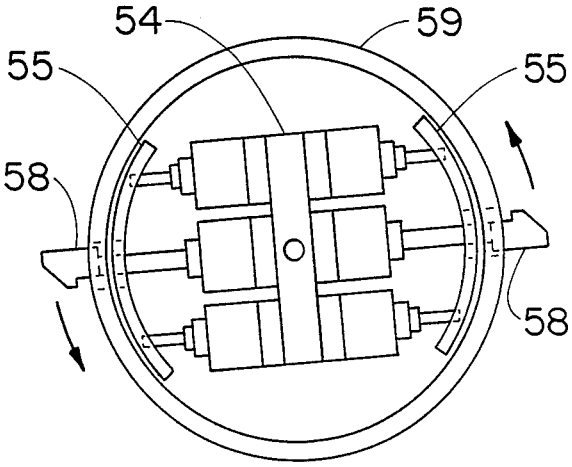
FIG. 20 is a plan view of the cutter blade shifting to another location.

Referring to FIG. 20, there is shown the cutter foundation 54 and all associated devices rotated about three degrees.

The cutter stabilizer guides 55 are withdrawn from the pile 59 wall to allow the whole device to rotate. When the stabilizer guides 55 rotates about two degrees, the cutter blades 58 are pulled in thus cutting the pile 59 as they are pulled in.

Figure 21:
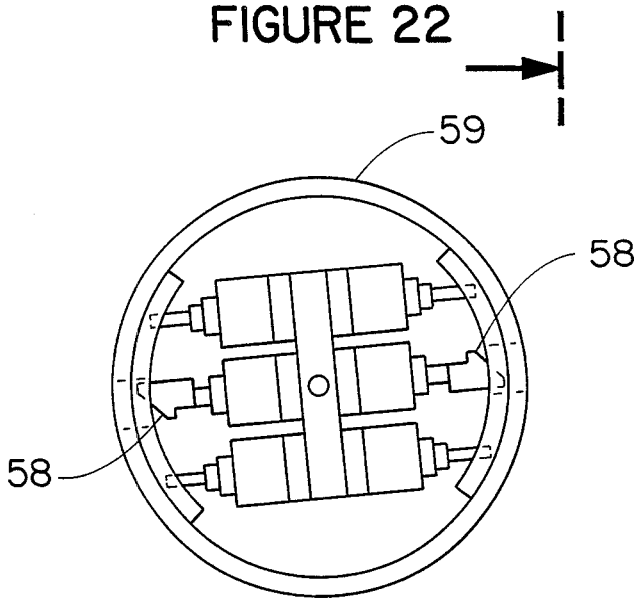
FIG. 21 is a plan view of the cutter blade after it is pulled through the pile enlarging the cut in the pile.

Referring to FIG. 21, there is shown the plan view of the cutter blades 58 after they have been pulled in thus cutting another section of pile 59. The cutter blades 58 will then be pushed back out, rotated by an actuator not shown in this view but similar to the actuator 16 as shown in FIG. 1, and again pulled back into the pile 59 further cutting the pile 59. The entire pile 59 will be severed in this manner.

Figure 22:
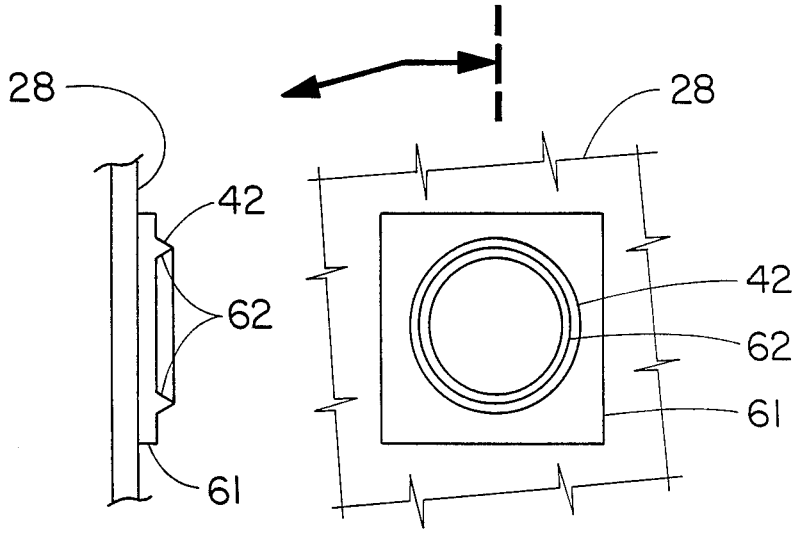
FIG. 22 is a detail of a radial gripping segment.

Referring to FIG. 22, there is shown two views of the radial gripping segments 42.

The radial gripping segments 42 are well used in lifting piles and other material and they are not new in the art.

The radial gripping segments 42 are square segments 61 with steel with rings 62 protruding from the square segments 61. The rings 62 are what is pushed into the steel to be gripped, slightly indenting the steel thus making it possible to grip the steel. The square segments 61 are fastened to the cutter stabilizer guide 28 or the stabilizer pads by welding or bolting or other suitable means.

Figure 23:
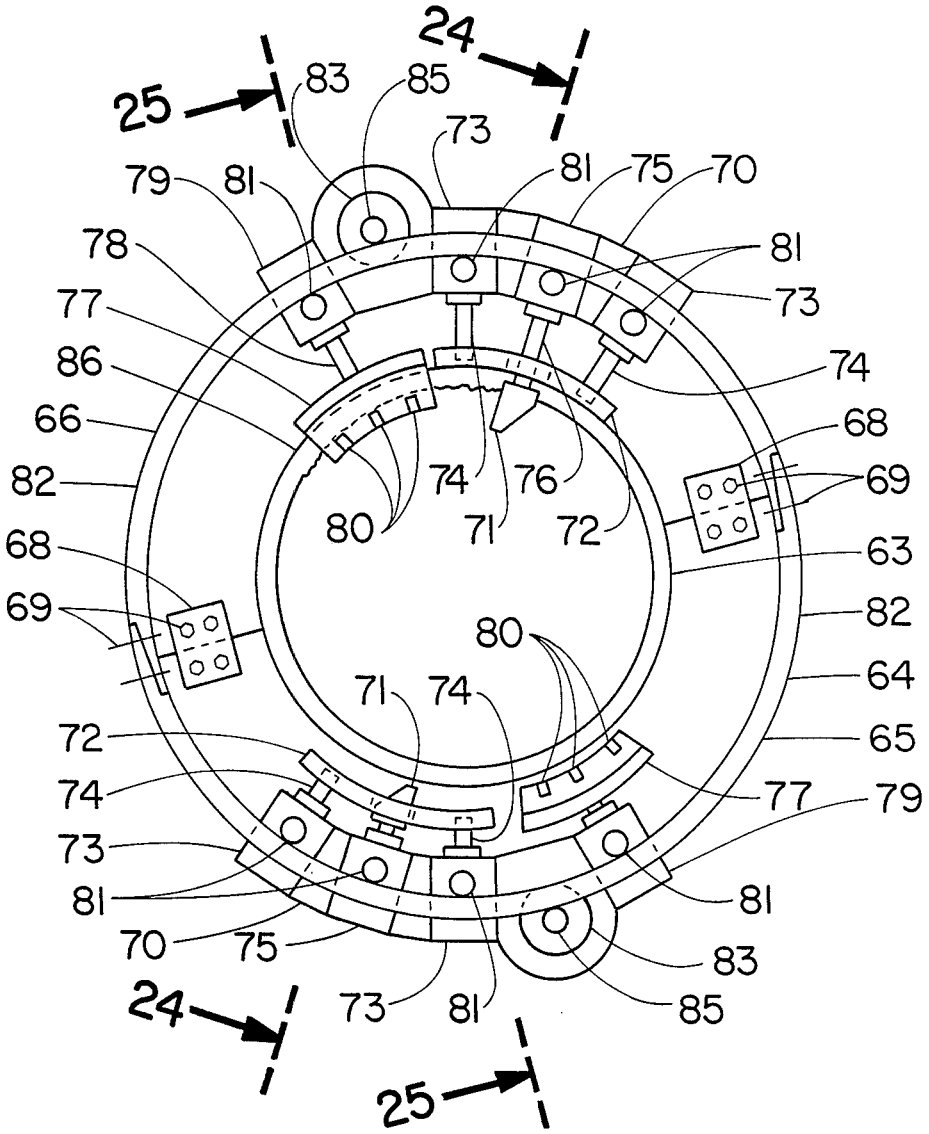
FIG. 23 is a plan view of still another embodiment of an exterior pile cutting device.

Referring to FIG. 23, there is shown still another embodiment of the invention.

This particular embodiment of the invention is similar to the other embodiments except that it cuts the pile 63 from the outside of the pile 63, grout or sleeve.

There could be situations that require the pile 63 to be cut from the outside.

The pile cutter frame 64 is set in place by divers or other suitable means and would be held in place on the pile 63 by friction, welding, bolting or some other suitable means.

The pile cutter frame 64 of FIG. 23 is shown to be made of two sections, 65 and 66. Sections 65 and 66 are carried down to the pile 63 or sleeve, not shown in two sections, and then locked together around the pile 63 with locking plates 68 and bolts 69. Other suitable means can be applied to fasten the two sections 65 and 66 together.

Once the sections are bolted together, one or more pile cutting devices 70 are placed on the pile cutter frame 64. The pile cutting devices 70 could also be placed on the pile cutter frame 64 on sections 65 and 66 before the two sections 65 and 66 are bolted together.

When the pile cutting devices 70 are suitably fastened to the pile cutter frame 64 and all the control lines and tubes are fastened to the pile cutting devices 70, the pile cutting may be started.

The pile cutting methods of the preferred embodiment and the other two embodiments are the same in this embodiment except the pile 63 is cut from the outside.

One pile cutting device 70 of this embodiment is shown cutting the pile 63 and the other is shown not cutting the pile 63. Both are the same devices but shown in different positions for illustrative purposes, however, there could be more than one pile cutting device 70 working at one time if desired.

The pile cutting device 70 of this embodiment has a cutter blade 71, a cutter stabilizer guide 72, stabilizer cylinders 73, stabilizer rods 74, cutter cylinders 75, cutter rods 76, spacers 77, spacer rods 78, spacer cylinders 79 and barbs 80. Each device has a cam follower 81 that will allow the pile cutting device 70 to be moved around on the cutter frame flange 82. The cam followers 81 are bearings that roll on the cutter frame flange 82 and take a lot of thrust when a particular device is in use. Skid units may also be used instead of cam followers 81.

To drive the pile cutting device 70 around the pile cutter frame 64 and the cutter frame flange 82, a motor 83 is used with a drive shaft 84 not seen in FIG. 23 and a drive wheel 85. The drive wheel 85 is shown as a friction drive wheel but it could also be a gear drive device.

The pile cutting device 70 is placed in the desired location on the pile 63. The cutter stabilizer guide 72 is pushed into the pile 63 by the stabilizer cylinders 73 and the stabilizer rods 74. The cutter cylinder 75 and cutter rod 76 push the cutter blade 71 into and through the pile 63. The cutter cylinder 75 and cutter rod 76 then withdraw the cutter blade 71 from the pile 63. The cutter stabilizer guide is withdrawn and the whole pile cutting device is moved by the motor 83 and drive wheel 85 the width of the cutter blade or about two degrees. When the pile cutting device 70 is moved the whole pile cutting operation is repeated until the pile is severed.

When the cut 86 in the pile is of sufficient length, the spacer 77 is thrust into the cut 86 until the barbs 87 catch the cut edge of the pile 63. The spacer rod 78 is then pulled out of the spacer 77, thus leaving the spacer 77 in the cut 86. Two or more spacers 77 may be required to support a pile 63 as it is being severed.

Figure 24:
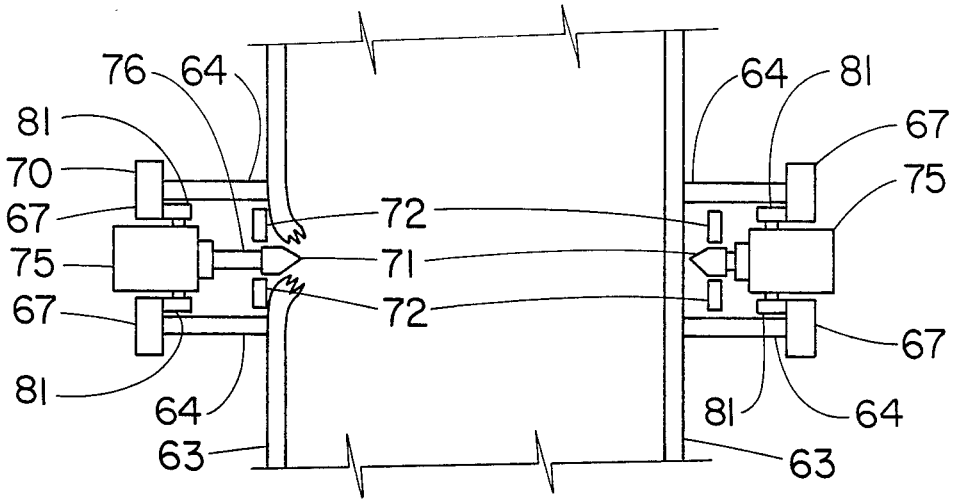
FIG. 24 is a section taken through FIG. 22 showing one cutter blade at rest and another cutter blade penetrating a pile.

Referring to FIG. 24, there is shown a section elevation of the cutter portion of the pile cutting device 70 as taken through FIG. 23.

The cutter blade 71 on the left is shown penetrating the pile 63. The cutter blade 71 is pushed into the pile 63 by cutter rod 76 and the cutter cylinder 75. The cutter cylinder 75 is reacting against the cam follower 81 which is reacting against the flange 67 of the pile cutter frame 64.

The cutter stabilizer guide 72 on the left side is shown pressing on the pile 63 and guiding the cutter blade 71 as it penetrates the pile 63.

The pile cutting device 70 on the right side of FIG. 24 is shown in an open position.

Figure 25:
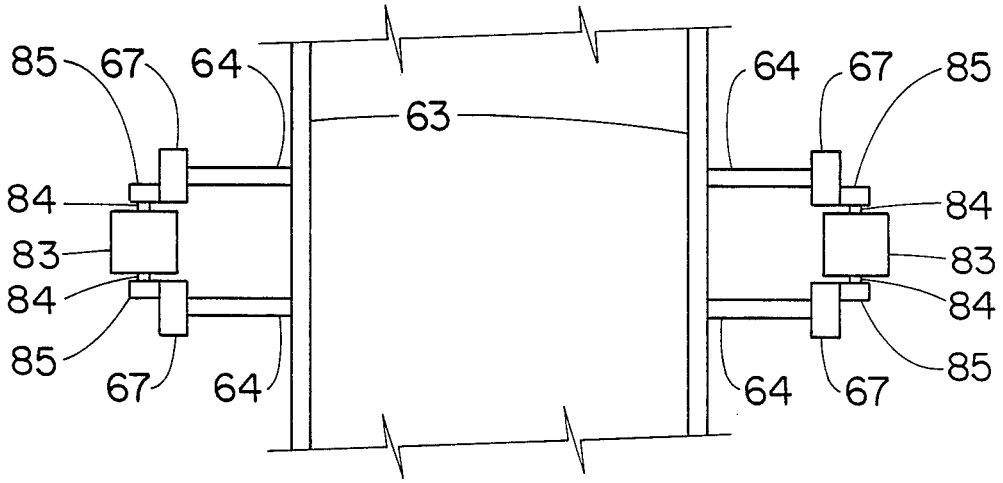
FIG. 25 is a section elevation showing the rotating motors for the cutter blades.

Referring to FIG. 25, there is shown a section elevation taken through FIG. 23.

The drive motor 83 is shown with the drive shaft 84 and the drive wheel 85 reacting against the flanges 67 of the pile cutter frames 64. The pile cutter frames 64 are shown suitably attached to the pile 63.

Figure 26:
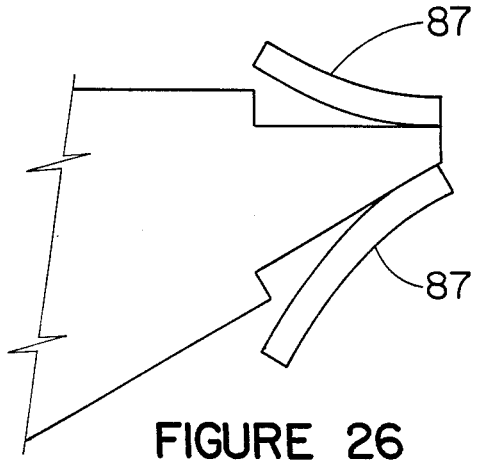
FIG. 26 is a detail of the barbs on the spacer.

Referring to FIG. 26, there is shown an enlarged view of the barb 87 of any of the embodiments.

The barb 87 could be made of spring steel and would be fastened to the spacer by screws, bolts or other suitable means. Care would have to be taken not to fasten the barbs 87 to each other whereby they could conduct current from one part of the severed pile to the other part of the severed pile. The barbs 87 could also be made up of a non-conductive material.

Although the system described in detail supra has been found to be most satisfactory and preferred, many variations in structure and method are possible. For example, the cutting blades can be pushed into the pile by rack and pinion and driven by an electric motor, all other items in the pile cutting device could be driven by electric motors. The cutting blades can be used to cut on an outward stroke or an inward stroke. The pile cutting device can be lowered into the pile by a crane above the pile or by a winch suitably attached to the pile. The pile cutting device could also be lowered into the pile by a pile jacking system that is suitably fastened to the pile cutting device.

Although the invention has been described with reference to the preferred embodiment and other embodiments, it will be understood by those skilled in the art, that additions, modifications, substitutions, deletions and other changes not specifically described, may be made in the embodiment herein, it should be understood that the details herein are to be interpreted as illustrative and not in a limiting sense.

What is described as invention is:

1. An apparatus for severing a pile that is setting in a vertical or near vertical position, while said pile is still bearing its own weight or the weight of another structure, comprising:

a guide tube, said guide tube having an outside diameter less than that of the inside diameter of said pile and said guide tube is adapted for movement up and down within said pile, said guide tube including frame members from which said guide tube may be lifted up or lowered down inside of said pile; a moveable guide plate mounted on said frame members and adapted for movement up and down relative to said frame members,;

a rotary actuator mounted on said guide plate, said rotary actuator having a shaft that rotates relative to said moveable guide plate;

a double ended rod cylinder mounted on said frame members; a double ended rod of said double ended rod cylinder to move up and down relative to said frame members, with the top end of said double ended rod fastened to said shaft of said rotary actuator;

a moveable foundation mounted at the lower end of said double ended rod, said moveable foundation to move up and down with said double ended rod relative to said frame members;

at least two cutter stabilizer guide assemblies mounted on said cutter foundation and adapted to move opposite of each other relative to said cutter foundation;

at least two cutter blade assemblies mounted on said cutter foundation and further mounted on each side of said cutter blade assembly, in the center is the cutter stabilizer guide assembly, said cutter blade assembly having at least one cutter blade that moves perpendicular to the wall of said pile and said cutter blade is guided and stabilized by said cutter stabilize guides as said cutter blade is pushed into said pile wall;

at least two spacer assemblies mounted on said cutter foundation below, said cutter blade assemblies, said spacer assembly having a spacer and said spacer having barbs protruding from said spacer;

at least two stabilizer assemblies spaced one hundred and eighty degrees apart from each other and mounted on said frame member, said stabilizer assembly with stabilizer pads, said stabilizer pads are pushed into said pile and lock said apparatus to said pile after which said double ended rod cylinder lowers said cutter blade assemblies and said spacer assemblies wherein said cutter blade assemblies proceed to cut into said pile forming a cut in said pile, and when said cut in said pile is of sufficient length to allow said spacer to be inserted into said cut until said barb catches onto said cut holding said spacer to said cut in said pile wherein said blade assembly proceeds to enlarge said cut until said cut extends around the entire circumference of said pile.

2. The apparatus of claim 1 wherein said spacer is made of a material that will electrically isolate the lower section of pile from the upper section of pile after the pile is severed.

3. The spacer of claim 1 wherein said spacer is held to said spacer assembly by friction and can be removed from said spacer assembly by withdrawing said spacer assembly from said spacer when said spacer is held in said cut by said barbs.

4. The spacer assembly of claim 1 wherein said spacer assembly is further equipped with an electric probe, said electric probe that will be thrust into the lower section of said severed pile.

5. The spacer assembly and stabilizer assembly of claim 1 wherein said spacer assembly and said stabilizer assembly have a common electric circuit, said electric circuit having a power source and a lamp, whereby said spacer is removed from said spacer assembly and said spacer assembly has an electric probe projecting from said spacer assembly, wherein said probe is thrust into the lower section of said pile, said lower section of said pile being severed from upper section of said pile, said electric circuit to prove said lower section of pile is severed from said upper section of said pile by causing said electric circuit to remain open thus preventing said lamp from being energized, if said lower section of pile is not completely severed from said upper section of said pile, said electric circuit will be complete causing said lamp to be energized with electricity and thus light up.

6. The cutter blade of claim 1 wherein said cutter blade cuts into said pile on an inward stroke.

7. The apparatus of claim 1 wherein said apparatus is equipped with an electric motor and a hydraulic pump.

8. An apparatus for severing a pile from the outside of said pile, comprising:

a pair of pile cutter frames extend around the circumference of said pile and including a flange on the outer periphery of each said pile cutter frames;

at least one pile cutter assembly with a cutter blade adapted to cut into a pile;

at least one cutter blade guide assembly adapted to guide and stabilize said cutter blade as it is being pushed into said pile,;

at least one spacer assembly with at least one spacer adapted to thrust said spacer into said cut;

at least one drive means said drive means to cause said cutter assembly, said cutter blade guide assembly and said spacer assembly to move around said pile on said flange;

at least two cam followers, said cam followers fixed on said cutter assembly, said cutter blade guide assembly, said spacer assembly and said drive means to hold said assemblies to said flange.

* * * * *